US005269664A

United States Patent [19]

Buse

[11] Patent Number: 5,269,664

[45] Date of Patent: Dec. 14, 1993

[54] MAGNETICALLY COUPLED CENTRIFUGAL PUMP

[75] Inventor: Frederic W. Buse, Allentown, Pa.

[73] Assignee: Ingersoll-Dresser Pump Company, Liberty Corner, N.J.

[21] Appl. No.: 55,395

[22] Filed: May 3, 1993

Related U.S. Application Data

[63] Continuation-in-part of Ser. No. 946,182, Sep. 16, 1992.

[51] Int. Cl.[5] ..... F04D 13/02

[52] U.S. Cl. ..... 417/360; 417/420

[58] Field of Search ..... 417/420, 360, 365; 415/110, 111, 112

[56] References Cited

U.S. PATENT DOCUMENTS

| | | | |
|---|---|---|---|
| 2,727,163 | 12/1955 | Meyer | 417/420 |
| 4,047,847 | 9/1977 | Oikawa | 417/370 |
| 4,304,532 | 12/1981 | McCoy | 417/420 |
| 4,645,433 | 2/1987 | Hauenstein | 417/420 |
| 4,648,808 | 3/1987 | Hauenstein | 417/353 |
| 4,806,080 | 2/1989 | Mizobuchi et al. | 417/353 |
| 4,812,108 | 3/1989 | Kotera | 415/111 |
| 4,871,301 | 10/1989 | Buse | 417/420 |
| 5,045,026 | 9/1991 | Buse | 464/29 |

FOREIGN PATENT DOCUMENTS

| | | | |
|---|---|---|---|
| 519935 | 12/1955 | Canada | 417/420 |

OTHER PUBLICATIONS

Richter Chemie-Technik Pump Brochure, Close-coupled pump, p. 8, dated Oct. 1987.

*Primary Examiner*—Richard E. Gluck
*Attorney, Agent, or Firm*—Michael H. Minns

[57] ABSTRACT

A single stage end suction centrifugal pump with a close coupled motor radial magnetic drive. The pump is comprised of a pump housing with a pumping chamber and having an inlet and an outlet. A sealing diaphragm is removably mounted to the pumping chamber to seal the pump from the exterior and prevent pumped fluid from leaking from the pumping chamber. A separate support housing for attaching a motor to the pump housing. The sealing diaphragm and the support housing each being separately attached to the pump housing. Therefor, the support housing and motor can be removed from the pump housing without removing the sealing diaphragm.

23 Claims, 4 Drawing Sheets

MAGNETICALLY COUPLED CENTRIFUGAL PUMP

This application is a continuation in part of application Ser. No. 07/946,182, filed Sep. 16, 1992.

BACKGROUND OF THE INVENTION

This invention relates generally to centrifugal pumps magnetically coupled to a rotary drive and more particularly to pumps having a sealing diaphragm between the driving magnets and the driven magnets.

Magnetic centrifugal pumps are utilized where an absolutely tight seal towards the outside is a concern since toxic, caustic or aggressive agents are to be pumped without leakage into the environment. A magnetic rotational coupler is provided in a magnetic centrifugal pump.

One particular type of magnetic coupler has inner and outer rotors including magnets disposed in mutually coaxial cylinders for magnetic coupling between the rotors. A separating diaphragm or containment shell is provided between the magnets of the inner and outer rotors. In this type of magnet coupler, the magnets are axially positioned. Most designs of magnetically coupled pumps use axially positioned magnets. A disadvantage with axially positioned magnets is that a pot shaped containment shell is required. This shell is expensive to manufacture and requires special tooling. The axial placement of the magnets makes the overall pump much longer axially. Axially positioned magnets also usually require two sets of product lubricated bearings.

The foregoing illustrates limitations known to exist in present magnetically coupled centrifugal pumps. Thus, it is apparent that is would be advantageous to provide an alternative directed to overcoming one or more of the limitations set forth above. Accordingly, a suitable alternative is provided including features more fully disclosed hereinafter.

SUMMARY OF THE INVENTION

In one aspect of the present invention, this is accomplished by providing a centrifugal pump comprising a pump housing containing a pumping chamber and having an inlet and an outlet, a sealing diaphragm removably mounted to the pumping chamber to seal the pump from the exterior and prevent pumped fluid from leaking from the pumping chamber, a stationary shaft mounted within the pumping chamber, a pump impeller rotatable about the stationary shaft, a plurality of driven magnets attached to the pump impeller, the plurality of driven magnets being arranged in a plane, the plane being normal to the axis of the stationary shaft, a rotary driving device having a rotating shaft, the rotating shaft axis being aligned with the stationary shaft axis, a support housing for attaching the rotary driving device to the pump housing, the sealing diaphragm and the support housing each being separately attached to the pump housing, and a plurality of driving magnets attached to the rotary driving device, the plurality of driving magnets being arranged in a plane, the plane being normal to the axis of the rotating shaft, the plurality of driving magnets being magnetically coupled with the plurality of driven magnets.

The foregoing and other aspects will become apparent from the following detained description of the invention when considered in conjunction with the accompanying drawing figures.

BRIEF DESCRIPTION OF THE DRAWING FIGURES

DETAILED DESCRIPTION

Figure 1:
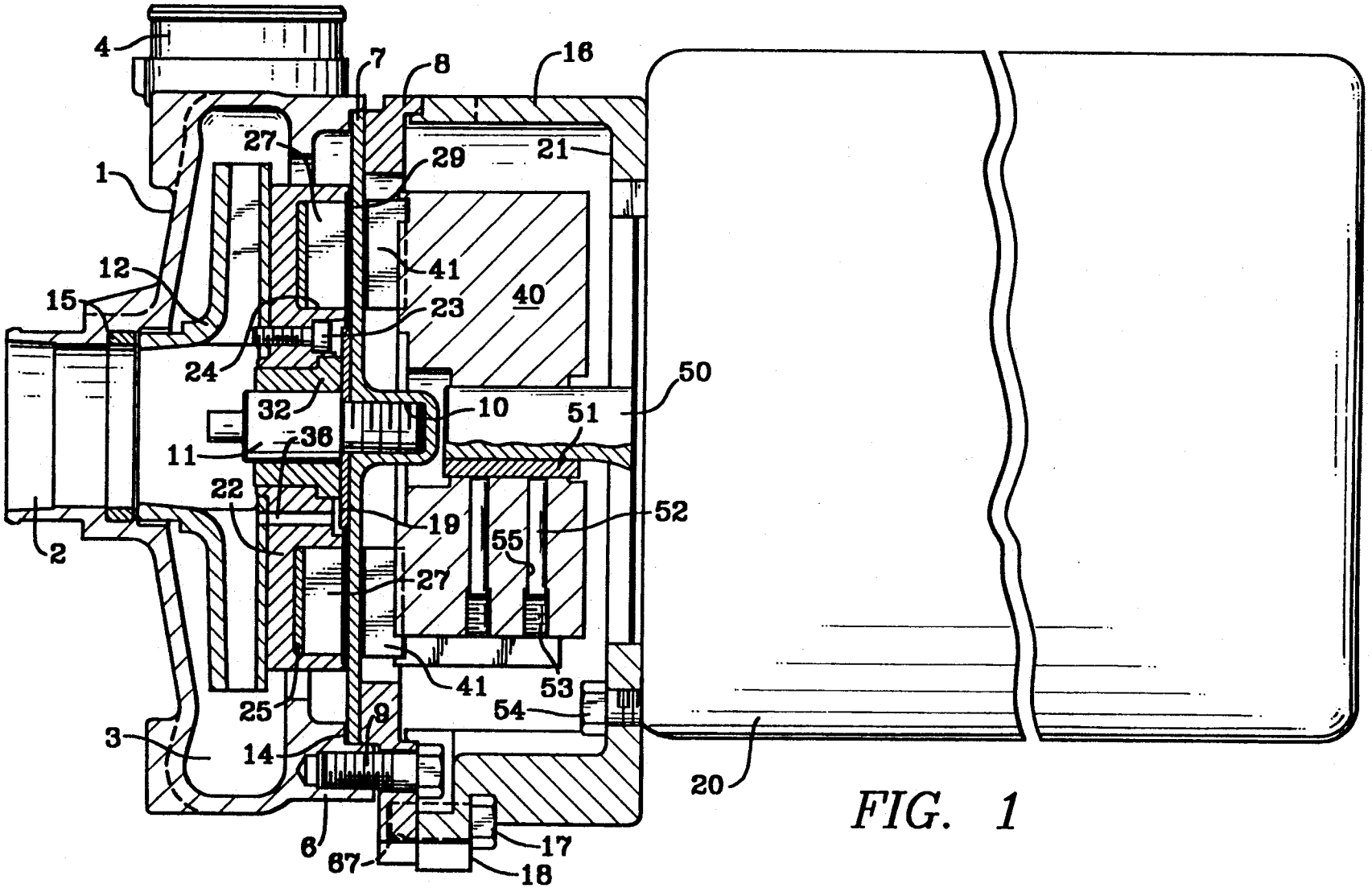
FIG. 1 is a vertical section (taken from line 1—1 of FIG. 2) of a radially magnetic coupled pump according to the present invention.
Figure 2:
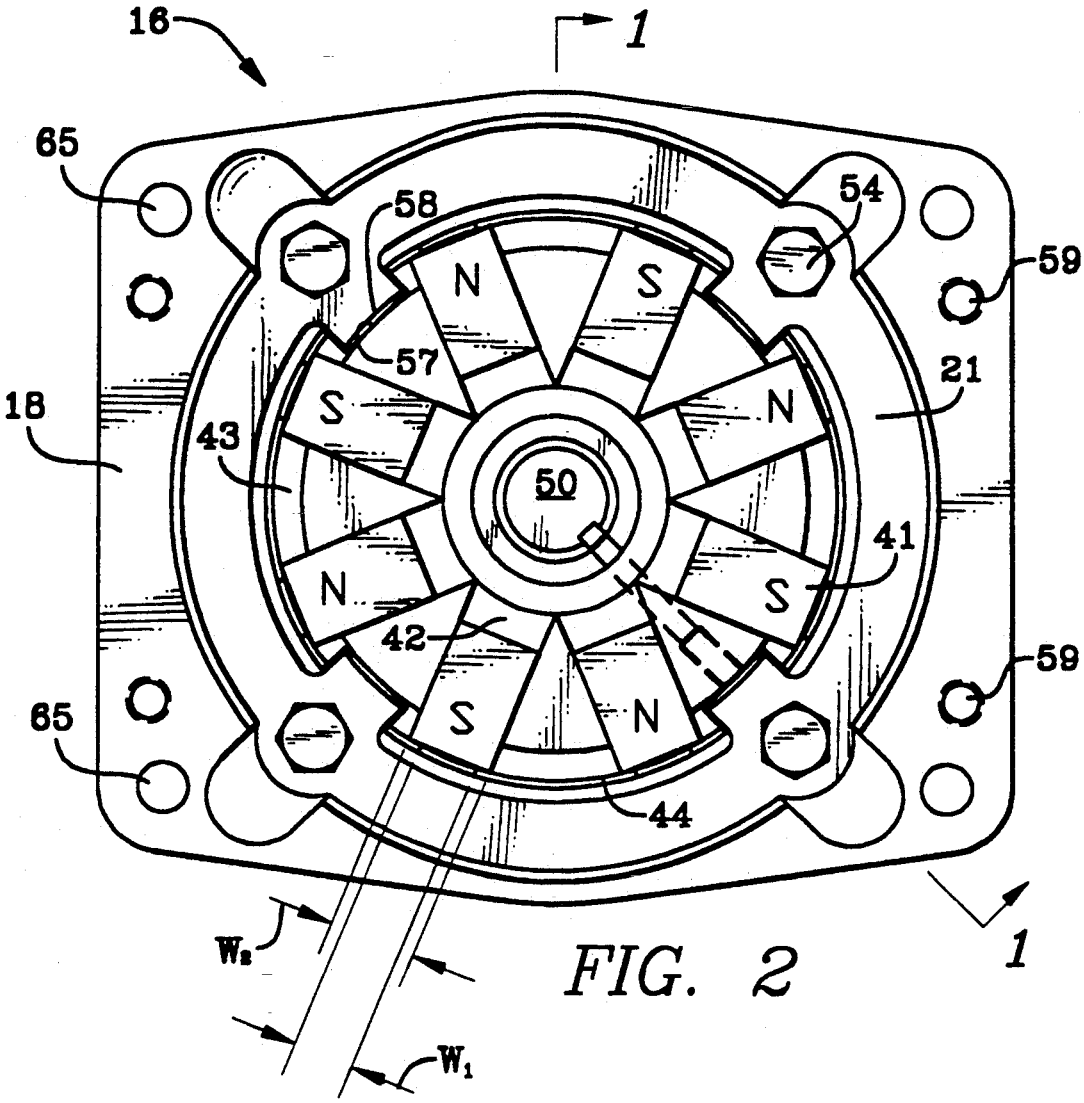
FIG. 2 is an end view of the support housing and outer magnet carrier.
Figure 3:
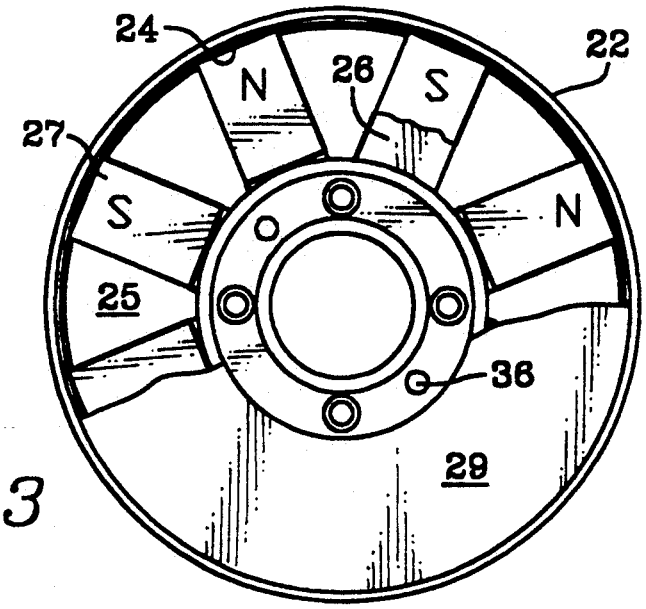
FIG. 3 is an end view of the inner magnet carrier.
Figure 4:
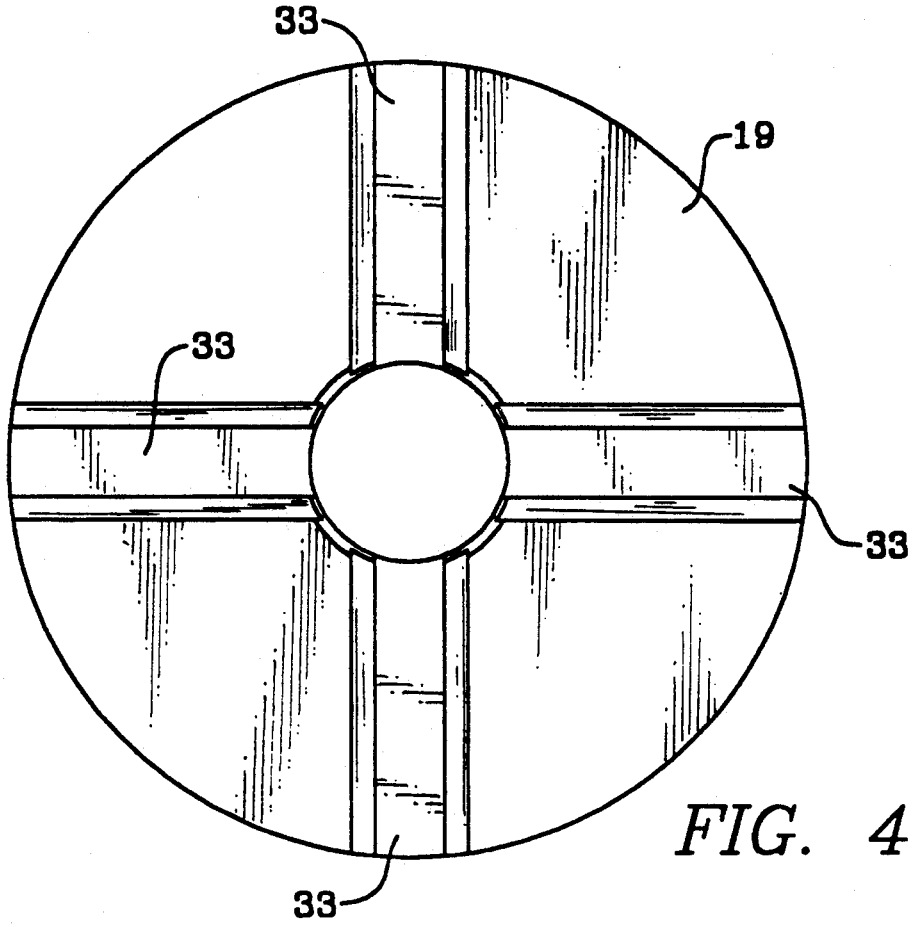
FIG. 4 is an enlarged plan view of the thrust collar.

The sealless centrifugal pump shown in the drawings includes a pump housing 1 containing an axial inlet 2, a pumping chamber 3 and an outlet 4, all of which are interconnected by passages extending through the pump housing. The pump housing 1 also contains an annular flange 6 surrounding the pumping chamber 3. The annular flange 6 is adapted to receive a sealing diaphragm 7 and support ring 8. The sealing diaphragm 7 prevents liquid from leaking to the atmosphere, thus making the pump "sealless". A seal gasket 14 is located between the sealing diaphragm 7 and the annular flange 6. The support ring 8 is attached to the annular flange 6 with a plurality of bolts 9.

Figure 7:
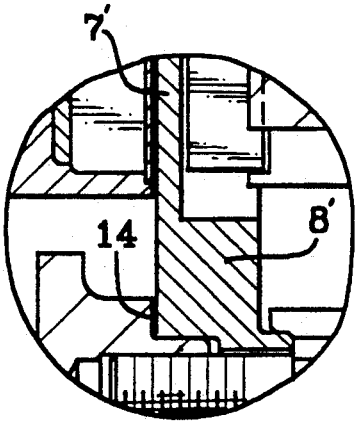
FIG. 7 is a partial cross-section showing an alternate embodiment of the sealing diaphragm.

An alternate embodiment of the sealing diaphragm 7' is shown in FIG. 7. The support ring 8' is integral with the sealing diaphragm 7'.

Figure 1A:
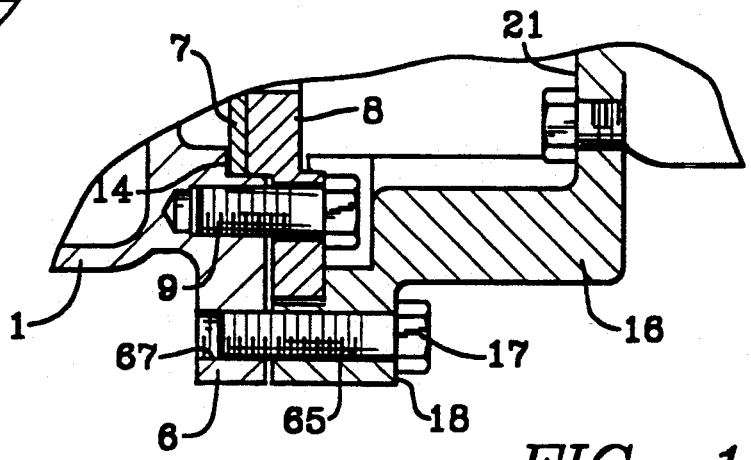
FIG. 1A is a partial cross-section showing an alternate embodiment of the support housing.

An alternate embodiment of the pump housing 1 and the motor support frame 16 is shown in FIG. 1A. The annular flange 6 is extended so that the motor support frame 16 is bolted to the annular flange 6 of the pump housing 1. The preferred embodiment for attaching the motor support frame 16 is shown in FIG. 1, where the motor support housing frame 16 is attached to the support ring 8.

An axially extending stationary shaft 11 carrying a pump impeller 12 rotating in the pump chamber 3 during pump operation is attached to a threaded hole 10 formed in the sealing diaphragm 7. The stationary shaft 11 may also be attached to sealing diaphragm 7 by a press fit into an aperture or welded to the sealing diaphragm. A thrust collar 19 located between the stationary shaft 11 and the sealing diaphragm 7 absorbs the primary axial force on the impeller. An auxiliary thrust collar 15 is located in the axial inlet 2 adjacent the eye of the impeller 12 to absorb reversed axial loads if they occur. A bushing 32 is press fit into the impeller 12. The sliding interface is between the stationary shaft 11 and the bushing 32. The impeller 12 and bushing 32 are not secured to the stationary shaft 11. The impeller 12 is a "floating" impeller.

An annular disc shaped inner magnet carrier 22 is attached to the back of the impeller 12 with a plurality of bolts 23. The inner magnet carrier 22 has an annular groove 24 located in the face of the carrier 22 adjacent the sealing diaphragm 7. A carbon steel conducting ring 25 is welded in this groove 24. The conducting ring 25 has a plurality of magnet receiving slots 26 located in its exposed face. A plurality of high strength magnets 27 are located in the magnet receiving slots 26. The magnets are preferably rare earth magnets. The sides of the annular groove 24 and the sides of the magnet receiving slots 26 form a pocket to retain the magnets 27 in place without further retention means, such as by welding or glue. These pockets resist the centrifugal force on the magnets from impeller 12 rotation and prevent the magnets 27 from slipping radially around the annular groove 24. A stainless steel or polymer cover 29 is attached to the inner magnet carrier 22 over the magnets 27 to seal the magnets 27 from the pumped fluid.

The sealing diaphragm 7 is preferably formed from Hastelloys ® C or a nonmetallic material. The material of choice depends on the pumped fluid and the operating temperature and pressure. The material thickness and axial means of supporting the diaphragm define the amount of torque the magnets can transmit, the pressure the pump is rated for, and how much the diaphragm can bend. When the diaphragm 7 is made of a metal like Hastelloy ® C, the magnets produced eddy currents in the diaphragm 7. The eddy current losses can be as much as 20% of the power and also heat the pumped fluid. Hastelloy ® C is one of the metals which produce the least amount of eddy currents. 316 stainless steel produces at least twice as much eddy current losses. Nonmetallic diaphragms produce no eddy current losses. Nonmetallic diaphragms formed from ceramic, tempered glass, Ryton ® and Polyamide have been tested. Ceramic has a high bending strength but is brittle. Tempered glasses do not have good bending strength. Most composite materials such as Ryton ® do not have good strength. Polyamide has a strength between Ryton ® and Hastelloy ® C. Polyamide is the preferable non-metallic material for the sealing diaphragm 7.

One of the features of this pump is to be able to run "tank dry" for greater than 30 minutes. "Tank dry" is the condition where the supply tank to the pump is empty. This is a different condition from where there is no liquid whatsoever in the pump. Most pump designs cannot run "tank dry" for greater than 3 minutes. The extended "tank dry" running condition is accomplished by the design of the thrust collar 19, the stationary shaft 11 and the impeller bushing 32. During "tank dry" conditions, a small amount of liquid remains in the pumping chamber 3. Testing has shown that this liquid swirls around the eye of the impeller 12 in the shape of a donut. This swirling liquid does not provide any lubrication or cooling for the pump bushing or bearings.

The thrust collar 19 has a plurality of grooves 33 in the face of the collar adjacent the bushing 32. The edge of the central aperture in the bushing 32 is chamfered on the face adjacent the thrust collar 19. The stationary shaft 11 has a plurality of axially extending grooves 35. The stationary shaft is installed with the grooves 35 aligned with and in fluid communication with the thrust collar grooves 33. If the stationary shaft grooves 35 are not in alignment with the thrust collar grooves 33, the fluid communication is via the chamfered edge of bushing 32. Two recirculation passages 36 are located in the inner magnet carrier 22 and impeller 12. The recirculation passages 36 extend from near the eye of the impeller 12 to the area between the inner magnet carrier 22 and the sealing diaphragm 7.

Figure 6:
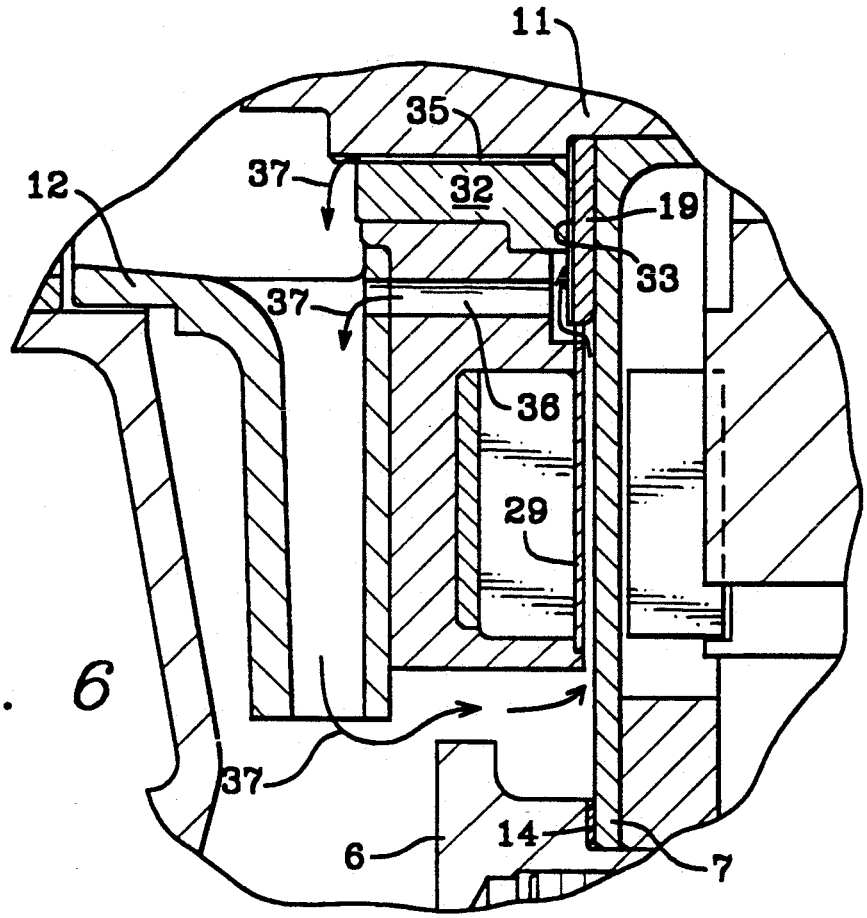
FIG. 6 is an enlarged cross-sectional view of the impeller, stationary shaft, bushing and thrust collar.

The thickness of the thrust collar 19 in combination with the axial thickness of the inner magnet carrier 22 and the magnetic field strength determines the minimum clearance between the inner magnet carrier 22 and the sealing diaphragm 7. The preferred clearance when the pump is operating is 0.025 to 0.050 inches. (The clearance shown in FIG. 6 is exaggerated) Because of this clearance, the recirculation passages 36 and the grooves 33, 35, a fluid circulation path 37 (shown by the arrows in FIG. 6) is established from the outlet of the impeller 12, between the inner magnet carrier 22 and the sealing diaphragm 7, through the thrust collar grooves 33, through the stationary shaft grooves 35 and back to the eye of the impeller 12. Since the clearance between the inner magnet carrier 22 and the sealing diaphragm 7 is small and the grooves 33, 35 are small, this fluid circulation path 37 does not materially affect the quantity of pumped fluid through the PUMP. This fluid circulation provides the necessary cooling and lubrication flow to prevent pump damage during "tank dry" conditions.

An electric motor 20 provides the driving force for the magnetically coupled centrifugal pump. A motor support frame 16 attaches the motor 20 to the pump by bolts 17 which are screwed into threaded holes 67 in support ring 8. The motor support frame 16 attaches to the pump separately from the sealing diaphragm 7. This allows the motor 20 to be removed from the pump without breaching the pump boundary. Since the sealing diaphragm 7 is bolted separately to the pump housing 1, the sealing diaphragm 7 remains sealingly attached to the pump housing 1 when the motor support frame 16 and motor 20 are removed from the pump housing. Thus, the motor can be removed without draining the pump or leaking any of the pumped fluid. In the preferred embodiment, the motor support frame 16 is attached to the support ring 8. The motor support frame 16 can also be attached directly to the pump or the pump annular flange 6. The motor 20 has a rotating shaft 50. This shaft 50 is aligned with the stationary shaft 11. Motor shaft 50 has an axial keyway.

An outer magnet carrier 40 is attached to the motor shaft 50. The preferred form for the outer magnet carrier 40 is a massive cylindrical flywheel, as shown in FIG. 1. The outer magnet carrier 40 has two key apertures 55 and is attached to the motor shaft 50 by a key 51 retained in the motor shaft keyway and a corresponding slot in a central aperture in the outer magnet carrier 40. The outer magnet carrier 40 is tightened in position by retaining screws 53 and pins 52 located in key apertures 55. The outer magnet carrier 40 has four axial slots 57 equally spaced about its cylindrical surface. The key apertures 55 are located in one of the axial slots 57.

The face of outer magnet carrier 40 adjacent the sealing diaphragm 7 has an annular groove 43 adjacent the outer circumference. A lip 44 is formed at the outer edge of groove 43. A plurality of magnet retaining slots 42 are formed in the face of the outer magnet carrier 40 adjacent the sealing diaphragm 7. High strength magnets 41 (preferably rare earth magnets) are located in the magnet retaining slots 42. The width $w_1$ of the magnet retaining slot 42 is approximately the same as the width of the magnet 41. The magnet retaining slots 42 are formed by milling the slot with a mill cutter having a diameter approximately the same as the width of the magnets 41. The slot is milled from the center of the face of the outer magnet carrier 40 towards the outer edge of the outer magnet carrier. The portion of the slot in lip 44 is not milled to the full width $w_1$. The cutting is stopped before the mill cutter fully cuts the lip 44.

The width $w_2$ of the slot in the lip 44 is less than width $w_1$. This allows the magnet retaining slot 42 to be milled the full width of the magnet except for the portion in lip 44. The sides of the magnet retaining slots 42 and lip 44 form a pocket to retain the magnets 41 in place without further retention means, such as by welding or glue. The lip 44 resists the centrifugal force on the magnets from motor 20 rotation and the sides of the magnet retaining slots 42 prevent the magnets 42 from slipping radially around the face of the outer magnet carrier 40.

In the preferred embodiment, eight driving magnets 41 and eight driven magnets 27 are used. Other combinations of four and four or eight and four magnets may be used depending upon the power requirements of the pump.

The motor support housing 16 has a cylindrical shape with a externally extending pump bolting flange 18 about one end of the cylinder. The pump bolting flange 18 has a plurality of unthreaded pump mounting holes 65 for bolts 17 to fasten the motor support housing 16 to the support ring 8. The end of the motor support housing 16 opposite the pump bolting flange 18 has a motor bolting flange 21 extending inwardly of the cylinder. Four tabs 58 project inwardly from motor bolting flange 21. Bolts 54 are used fasten the motor support housing 16 to the motor 20. The motor bolting flange 21 and tabs 58 are designed to interface with a NEMA 56 frame motor. The size and positioning of axial slots 57 in the outer magnet carrier 40 correspond to the size and positioning of the tabs 58.

To assembly the motor support housing 16, outer magnet carrier 40 and motor 20, the outer magnet carrier 40 is attached to the motor shaft 50 by key 51, pins 52 and retaining screws 53. The outer magnet carrier 40 is rotated until axis slots 57 are aligned with tabs 58. The motor support housing 16 is slipped over the assembled motor 20 and outer magnet carrier 40, and then bolted to motor 20 by bolts 54. Other prior art magnetically coupled pumps attach the outer magnet carrier to the motor shaft after the motor support is fastened to the motor. This requires either bolting the magnet carrier to the end of the motor shaft or apertures in the motor support housing to allow access to the key restraining screws.

When the pump and motor are assembled, the magnets 27, 41 pull the inner magnet carrier 22 and outer magnet carrier 40 towards one another with about 80 pounds of force. In order to remove the motor assembly from the pump, this force must be overcome. Following is a description of one means for overcoming this magnetic force.

Figure 5:
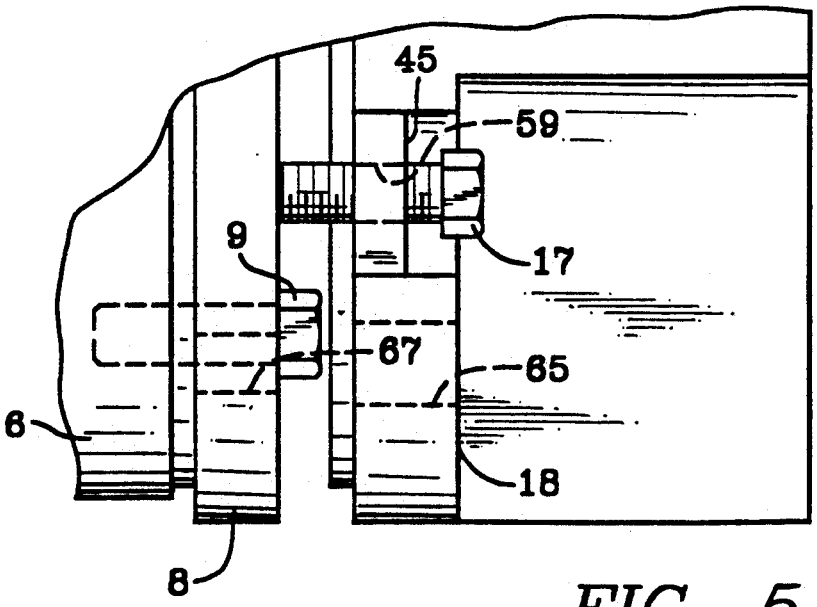
FIG. 5 is an enlarged partial elevational view showing the details of the motor and outer magnet carrier assembly removal.

A plurality of threaded disassembly holes 59 are located about the pump bolting flange 18. The disassembly holes 59 are used in conjunction with bolts 17 to remove the motor 20, motor support housing 16 and outer magnet carrier 40 assembly from the pump. The bolts 17 are removed from the motor support housing 16 and the corresponding threaded holes 67 in the support ring 8. Bolts 17 are then threaded into disassembly holes 59. The bolts 17 are continued to be threaded into disassembly holes 59 until the bolts 17 extend through the pump bolting flange 18 and begin to push the motor assembly away from the pump, as shown in FIG. 5. In order to sufficiently separate the motor assembly from the pump (to the point that the magnetic attraction forces are significantly reduced), the areas 45 of the pump bolting flange 18 adjacent the disassembly holes 59 have a reduced thickness. This allows the bolts 17 to protrude through the pump bolting flange 18 without having to by any longer than necessary to bolt the motor support housing 16 to the support ring 8. If the alternate embodiment shown in FIG. 1A is used, the motor support housing 16 is bolted to the pump housing 1. The diassembly holes 59 may be adjacent either the pump housing 1 or the support ring 8.

The motor support housing 16 is unique in its shape for a NEMA 56 frame motor. Prior art motor support housings require molding cores to make the desired shape. The present motor support housing 16 has no radial holes or passages so that it can be made with a "match plate" pattern. This shape is also unique because it can pass over the assembled outer magnet carrier 16 without disturbing the carrier. This allows the outer magnet carrier 16 to be accurately axially positioned on the motor shaft 50 before the support housing 16 is assembled.

Having described the invention, what is claimed is:

1. A centrifugal pump comprising:

a pump housing containing a pumping chamber and having an inlet and an outlet;

a removable sealing diaphragm sealingly attached to the pump housing to seal the pump from the exterior and prevent pumped fluid from leaking from the pumping chamber, the pump housing and sealing diaphragm defining a first portion;

a stationary shaft mounted within the pumping chamber;

a pump impeller rotatable about the stationary shaft;

a plurality of driven magnets attached to the pump impeller, the plurality of driven magnets being arranged in a plane, the plane being normal to the axis of the stationary shaft;

a rotary driving device having a rotating shaft, the rotating shaft axis being aligned with the stationary shaft axis;

a support housing means for removably attaching the rotary driving device to said first portion, the sealing diaphragm remaining sealingly attached to the pump housing when the support housing means is removed from said first portion; and a plurality of driving magnets attached to the rotary driving device, the plurality of driving magnets being arranged in a plane, the plane being normal to the axis of the rotating shaft, the plurality of driving magnets being magnetically coupled with the plurality of driven magnets.

2. The centrifugal pump according to claim 1 further comprising:

a diaphragm support ring for attaching the sealing diaphragm to the pump housing.

3. The centrifugal pump according to claim 2 wherein the diaphragm support ring and the sealing diaphragm are a monolithic unit.

4. The centrifugal pump according to claim 1 wherein the stationary shaft is mounted on the sealing diaphragm.

5. The centrifugal pump according to claim 1, further comprising:

a thrust collar adjacent the sealing diaphragm, the thrust collar having a first face juxtaposed the sealing diaphragm and a second face distal the sealing diaphragm, the thrust collar being located about the stationary shaft;

an inner magnet carrier attached to the pump impeller, the driven magnets being located on the inner magnet carrier; and a bushing attached to the inner magnet carrier, the bushing being located about the stationary shaft.

6. The centrifugal pump according to claim 5, further comprising:

a means for lubricating and cooling the bushing, the means comprising a plurality of grooves on the second face of the thrust collar, and a plurality of axial grooves on the stationary shaft, the axial grooves being proximate the bushing, the thrust collar grooves being in fluid communication with the stationary shaft axial grooves.

7. The centrifugal pump according to claim 6, further comprising:

a plurality of passages extending through the inner magnet carrier and the pump impeller, the plurality of passages being proximate the bushing.

8. The centrifugal pump according to claim 1, wherein the pump impeller is permitted to move axially with respect to the stationary shaft.

9. The centrifugal pump according to claim 8, further comprising:

an auxiliary thrust collar within the pumping chamber, the auxiliary thrust collar being coaxial with the axis of the stationary shaft and proximate the inlet.

10. The centrifugal pump according to claim 1, further comprising:

an inner magnet carrier attached to the pump impeller, the inner magnet carrier being located between the pump impeller and the sealing diaphragm, the inner magnet carrier having a disk like shape, an annular groove being located on the face of the inner magnet carrier adjacent the sealing diaphragm, the annular groove having a depth; and a conducting ring n the annular groove, the axial thickness of the conducting ring being less than the depth of the annular groove so that the conducting ring is recessed within the annular groove, the conducting ring having a plurality of radially extending slots in the surface of the conducting ring adjacent the sealing diaphragm, the sides of each slot being parallel to one another, the driven magnets being located in the conducting ring slots, the thickness of the driven magnets being such that the driven magnets are recessed within the annular groove, the sides of the conducting ring slots and the annular groove preventing the driven magnets from moving radially about the annular groove and away from the axis of the stationary shaft.

11. The centrifugal pump according to claim 10, further comprising:

a disk shaped seal attached to the inner magnet carrier over the annular groove, the disk shaped seal sealing the driven magnets from the pumped fluid within the pumping chamber.

12. The centrifugal pump according to claim 1, further comprising:

an outer magnet carrier attached to the rotating shaft, the outer magnet carrier having a cylindrical shape and mass such that the outer magnet carrier acts as an inertial flywheel, the face of the outer magnet carrier adjacent the sealing diaphragm defining a first face, a plurality of radially extending slots being located in the first face, the sides of each slot being parallel to one another, the driving magnets being located in the slots, the sides of the slots preventing the driving magnets from moving radially about the first face of the outer magnet carrier.

13. The centrifugal pump according to claim 12 wherein the end of each slot proximate the outer circumference of the cylindrical outer magnet carrier has a lip, the lip preventing the driving magnets from moving away from the axis of the rotating shaft.

14. The centrifugal pump according to claim 1, further comprising:

an outer magnet carrier attached to the rotating shaft, the outer magnet carrier having a cylindrical shape and mass such that the outer magnet carrier acts as an inertial flywheel, a plurality of axially extending grooves in the cylindrical surface of the outer magnet carrier; and the support housing means having a hollow cylindrical shape open at one end, the opposite end having a circular aperture therethrough, the area adjacent the circular aperture defining a flange, a plurality of tabs extending radially inward from the flange, the tabs being of complementary shape, size and position with the outer magnet carrier axially extending grooves.

15. The centrifugal pump according to claim 3 wherein the support housing means is removably attached to the diaphragm support ring.

16. A centrifugal pump comprising:

a pump housing containing a pumping chamber and having an inlet and an outlet;

a sealing diaphragm removably mounted to the pumping chamber to seal the pump from the exterior and prevent pumped fluid from leaking from the pumping chamber;

a stationary shaft mounted within the pumping chamber;

a pump impeller rotatable about the stationary shaft;

a plurality of driven magnets attached to the pump impeller, the plurality of driven magnets being arranged in a plane, the plane being normal to the axis of the stationary shaft;

a rotary driving device having a rotating shaft, the rotating shaft axis being aligned with the stationary shaft axis;

a outer magnet carrier attached to the rotating shaft, the outer magnet carrier having a cylindrical shape and mass such that the outer magnet carrier acts as an inertial flywheel, a plurality of axially extending grooves in the cylindrical surface of the outer magnet carrier;

a plurality of driving magnets being located on the outer magnet carrier adjacent the sealing diaphragm, the plurality of driving magnets being arranged in a plane, the plane being normal to the axis of the rotating shaft, the plurality of driving magnets being magnetically coupled with the plurality of driven magnets; and a support housing means for attaching the rotary driving device to the pump housing, the support housing means having a hollow cylindrical shape open at one end, the opposite end having a circular aperture therethrough, the area adjacent the circular aperture defining a flange, a plurality of tabs extending radially inward from the flange, the tabs being of complementary shape, size and position with the outer magnet carrier axially extending grooves.

17. A centrifugal pump comprising:

a pump housing containing a pumping chamber and having an inlet and an outlet;

a sealing diaphragm removably mounted to the pumping chamber to seal the pump from the exterior and prevent pumped fluid from leaking from the pumping chamber;

a stationary shaft mounted within the pumping chamber;

a pump impeller rotatable about the stationary shaft;

an inner magnet carrier attached to the pump impeller, the inner magnet carrier being located between the pump impeller and the sealing diaphragm;

a plurality of driven magnets located on the inner magnet carrier, the plurality of driven magnets being arranged in a plane, the plane being normal to the axis of the stationary shaft;

a rotary driving device having a rotating shaft, the rotating shaft axis being aligned with the stationary shaft axis;

an outer magnet carrier attached to the rotating shaft;

a support housing means for attaching the rotary driving device to the pump housing; and a plurality of driving magnets located on the outer magnet carrier, the plurality of driving magnets being arranged in a plane, the plane being normal to the axis of the rotating shaft, the plurality of driving magnets being magnetically coupled with the plurality of driven magnets;

the inner magnet carrier and the outer magnet carrier each being disk shaped and having a plurality of radially extending slots in a surface adjacent the sealing diaphragm, the sides of the slots being parallel to one another, the magnets being located in each slot, the end of the slot distal the center of the magnet carrier having a lip, the sides of the slots and the lip preventing each magnet from moving radially about the magnet carrier and away from the center of the magnet carrier.

18. A centrifugal pump comprising:

a pump housing containing a pumping chamber and having an inlet and an outlet;

a sealing diaphragm removably mounted to the pumping chamber to seal the pump from the exterior and prevent pumped fluid from leaking from the pumping chamber;

a stationary shaft mounted on the sealing diaphragm and being located within the pumping chamber;

a pump impeller rotatable about the stationary shaft, the pump impeller being permitted to move axially with respect to the stationary shaft;

a thrust collar adjacent the sealing diaphragm, the thrust collar having a first face juxtaposed the sealing diaphragm and a second face distal the sealing diaphragm, the thrust collar being located about the stationary shaft;

an inner magnet carrier being attached to the pump impeller, a plurality of driven magnets being located on the inner magnet carrier, the plurality of driven magnets being arranged in a plane, the plane being normal to the axis of the stationary shaft;

a bushing attached to the inner magnet carrier, the bushing being located about the stationary shaft;

a means for lubricating and cooling the bushing, the means comprising a plurality of grooves on the second face of the thrust collar, and a plurality of axial grooves on the stationary shaft, the axial grooves being proximate the bushing, the thrust collar grooves being in fluid communication with the stationary shaft axial grooves;

a rotary driving device having a rotating shaft, the rotating shaft axis being aligned with the stationary shaft axis;

a support housing means for attaching the rotary driving device to the pump housing; and a plurality of driving magnets attached to the rotary driving device, the plurality of driving magnets being arranged in a plane, the plane being normal to the axis of the rotating shaft, the plurality of driving magnets being magnetically coupled with the plurality of driven magnets.

19. The centrifugal pump according to claim 18, further comprising:

a plurality of passage extending through the inner magnet carrier and the pump impeller, the plurality of passages being proximate the bushing.

20. The centrifugal pump according to claim 1 wherein the support housing means is removably attached to the pump housing.

21. A centrifugal pump comprising:

a pump housing containing a pumping chamber and having an inlet and an outlet;

a sealing diaphragm removably mounted to the pump housing to seal the pump from the exterior and prevent pumped fluid from leaking from the pumping chamber, the pump housing and sealing diaphragm defining a first portion;

a stationary shaft mounted within the pumping chamber;

a pump impeller rotatable about the stationary shaft;

a plurality of driven magnets attached to the pump impeller, the plurality of driven magnets being arranged in a plane, the plane being normal to the axis of the stationary shaft;

a rotary driving device having a rotating shaft, the rotating shaft axis being aligned with the stationary shaft axis;

a support housing means for removably attaching the rotary driving device to said first portion; and a plurality of driving magnets attached to the rotary driving device, the plurality of driving magnets being arranged in a plane, the plane being normal to the axis of the rotating shaft, the plurality of driving magnets being magnetically coupled with the plurality of driven magnets;

the support housing means comprising a hollow cylindrical shape open at one end, the opposite end having a circular aperture therethrough, the area adjacent the circular aperture defining a motor bolting flange, a pump bolting flange extending radially outward from the open end of the support housing means, a plurality of pump mounting holes extending through the pump bolting flange, and a plurality of threaded disassembly holes extending through the pump bolting flange;

said first portion having a plurality of threaded apertures corresponding to the support housing means pump mounting holes;

a plurality of bolts extending through the support housing means pump mounting holes into said first portion threaded apertures thereby attaching the support housing means to said first portion;

the plurality of bolts being removable from the support housing means pump mounting holes and said first portion threaded apertures for engagement in the support housing means threaded disassembly holes, the length of each bolt being sufficient to extend through the pump bolting flange to press against said first portion thereby forcing the support housing means away from said first portion as the bolts are threaded through the support housing means threaded disassembly holes.

22. The centrifugal pump according to claim 21, further comprising:

a diaphragm support ring for attaching the sealing diaphragm to the pump housing, the diaphragm support ring and the sealing diaphragm being a monolithic unit, the support housing means being removable attached to the diaphragm support ring.

23. The centrifugal pump according to claim 21 wherein the support housing means is removably attached to the pump housing.

* * * * *

UNITED STATES PATENT AND TRADEMARK OFFICE

CERTIFICATE OF CORRECTION

PATENT NO. : 5,269,664

DATED : 12/14/93

INVENTOR(S) : Frederic W. Buse

It is certified that error appears in the above-indentified patent and that said Letters Patent is hereby corrected as shown below:

Column 3, line 14, delete "Hastelloys®"

and replace with --Hastelloy®--

Column 4, line 15, delete "PUMP" and replace with --pump--

Column 7, line 35, delete "n" and replace with --located in--

Column 10, line 14, delete "passage" and replace with --passages--

Signed and Sealed this

Twenty-first Day of June, 1994

*Attest:*

Bruce Lehman

BRUCE LEHMAN

*Attesting Officer*

*Commissioner of Patents and Trademarks*